US006056604A

United States Patent [19]

Roy et al.

[11] Patent Number: 6,056,604

[45] Date of Patent: May 2, 2000

[54] ELECTRICAL RECEPTACLE TERMINAL WITH A CONTACT SPRING BIASED AGAINST A SIDE OF THE RECEPTACLE WITHOUT SPREADING A SEAM IN THE SIDE OF THE RECEPTACLE

[75] Inventors: Dhirendra C. Roy, Plymouth; Richard J. Kakkuri, Rochester Hills; Robert J. Cue, South Lyon, all of Mich.

[73] Assignee: Framatome Connectors Interlock, Inc., Westland, Mich.

[21] Appl. No.: 09/124,140

[22] Filed: Jul. 29, 1998

[51] Int. Cl.[7] ..... H01R 13/187

[52] U.S. Cl. ..... 439/845

[58] Field of Search ..... 439/161, 843, 439/845, 842, 775, 844, 846, 847, 848

[56] References Cited

U.S. PATENT DOCUMENTS

| | | | |
|---|---|---|---|
| 3,370,265 | 2/1968 | Berg | 339/256 |
| 5,217,382 | 6/1993 | Sparks | 439/161 |
| 5,427,552 | 6/1995 | Zielinski et al. | 439/845 |
| 5,433,629 | 7/1995 | Yagi et al. | 439/843 |

*Primary Examiner*—Lincoln Donovan
*Assistant Examiner*—Michael C. Zarroli
*Attorney, Agent, or Firm*—Perman & Green, LLP

[57] ABSTRACT

An electrical receptacle terminal comprising a frame, and a leaf spring. The frame has a receptacle section for a male terminal. The receptacle section has a general shell configuration with one side of the shell having a seam therein. The seam is located to section the side of the receptacle section into two cantilevered side sections with each side section being cantilevered from an opposite wall of the receptacle section parallel to the seam. The leaf spring is movably captured within the receptacle. The leaf spring is biased against the shell of the receptacle section with opposite ends of the leaf spring contacting the side of the shell. The leaf spring has two pairs of support surfaces. One pair of the support surfaces is located at each of the opposite ends of the leaf spring. One support surface of each pair of support surfaces contacts a corresponding one of the cantilevered side sections adjacent the wall of the receptacle section from which the side section cantilevers so that when the male terminal is inserted into the receptacle section, the leaf spring is urged against the shell without substantially spreading the seam.

12 Claims, 3 Drawing Sheets

ELECTRICAL RECEPTACLE TERMINAL WITH A CONTACT SPRING BIASED AGAINST A SIDE OF THE RECEPTACLE WITHOUT SPREADING A SEAM IN THE SIDE OF THE RECEPTACLE

BACKGROUND OF THE INVENTION

1. Field of the Invention

The present invention relates to an electrical receptacle terminal and, more particularly, to an electrical receptacle terminal having a receptacle shell with a seam therein and having a floating spring therein.

2. Prior Art

U.S. Pat. No. 5,217,382 discloses a two-piece electrical receptacle terminal for receiving a male terminal. U.S. Pat. No. 5,433,629 discloses a female terminal which has a contact spring within the terminal. U.S. Pat. No. 3,370,265 discloses an electrical connector with a socket for a pin connector and a spring held within the socket.

SUMMARY OF THE INVENTION

In accordance with a first embodiment of the present invention, an electrical receptacle terminal is provided. The electrical receptacle terminal comprises a frame and a spring. The frame has a receptacle section for a male terminal. The receptacle section has a general shell configuration. One side of the shell has a seam therein and at least one edge parallel to the seam. The edge of the side is anchored to a remaining portion of the shell. The spring is movably captured within the receptacle. The spring is biased against the shell of the receptacle section. The spring has at least one support surface contacting the side of the shell having the seam. The support surface contacts the side adjacent the anchored edge of the side so that, when the male terminal is inserted into the receptacle section, the spring is urged against the shell without substantially spreading the seam.

In accordance with a second embodiment of the present invention an electrical receptacle terminal is provided. The electrical receptacle terminal comprises a frame, a first spring and a second spring. The frame has a receptacle section for a male terminal. The receptacle section has a general shell configuration with an open seam therein. The first spring is moveably captured within the receptacle section. The spring is biased against the shell of the receptacle. The second spring is located within the receptacle section to press the male terminal against the first spring when the male terminal is located within the receptacle section. The second spring is formed by a tab member extending from the frame into the receptacle section.

In accordance with a third embodiment of the present invention, an electrical receptacle terminal is provided. The electrical receptacle terminal comprises a friend with a receptacle section for a male terminal and a first spring movably captured within the receptacle section. The receptacle section has a general shell configuration with an open seam therein. The spring is biased against the shell of the receptacle. The frame has a member cantilevered from a side of the receptacle section to form a second spring within the receptacle section. The second spring is located in the receptacle section so that when the male terminal is located within the receptacle section, the second spring and first spring operate to sandwich the male terminal therebetween.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
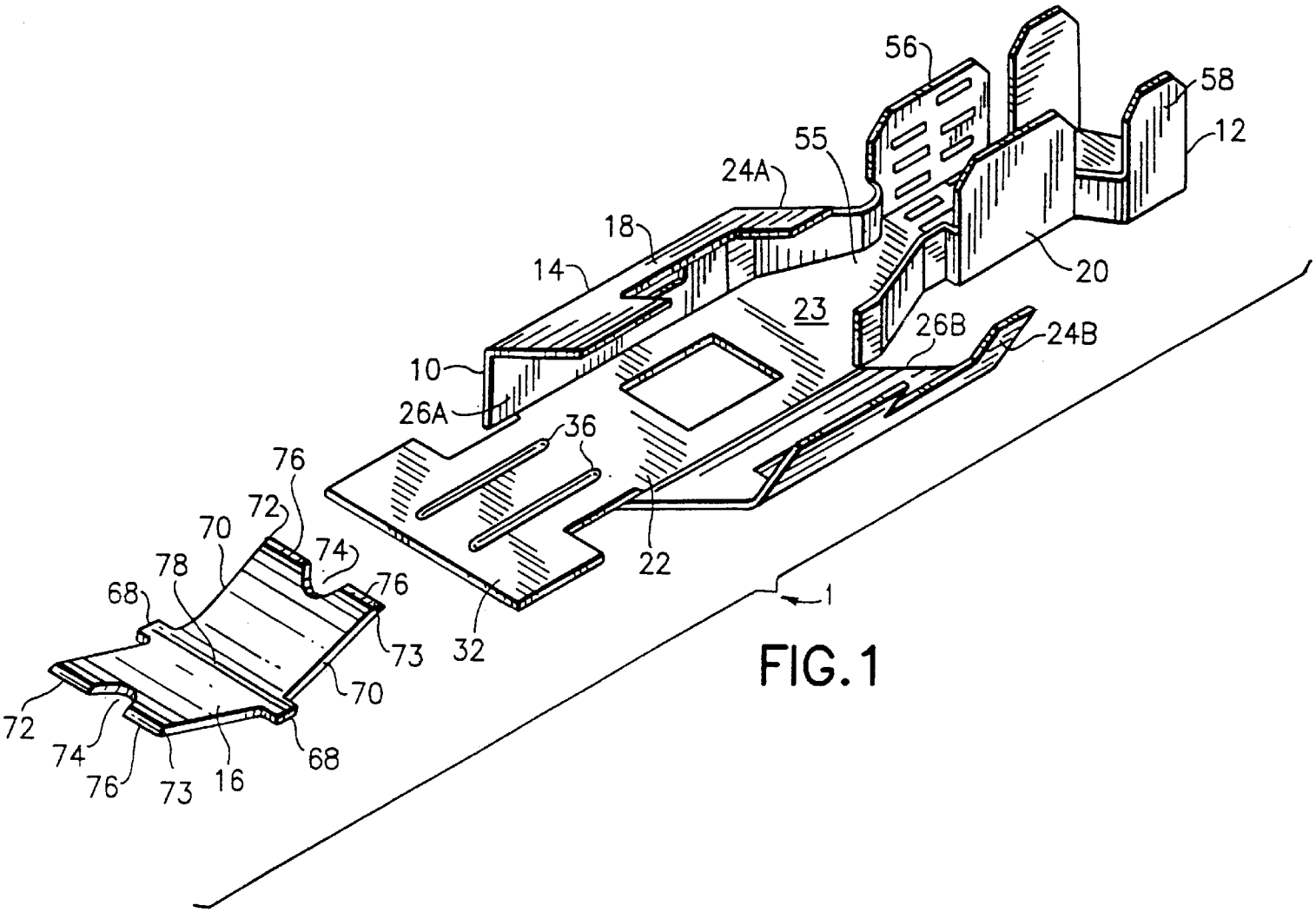
FIG. 1 is an exploded perspective view of an electrical receptacle terminal incorporating features of the present invention, the electrical receptacle terminal is shown with the receptacle section being partially formed.

Referring to FIG. 1, there is shown an exploded perspective view of an electrical receptacle terminal 1 incorporating features of the present invention. Although the present invention will be described with reference to the embodiment shown in the drawings, it should be understood that the present invention may be embodied in many forms of alternative embodiments. In addition, any suitable size, shape or type of materials or elements could be used.

The electrical receptacle terminal 1 is adapted to be mated to a male contact (not shown) at the front end 10 of the terminal 1. The rear end 12 of the terminal 1 is adapted to connect the terminal 1 to a conductor (not shown). The electrical receptacle terminal 1 comprises a terminal body 14 and a spring 16. The spring 16 is mounted to the terminal body 14.

Figure 2:
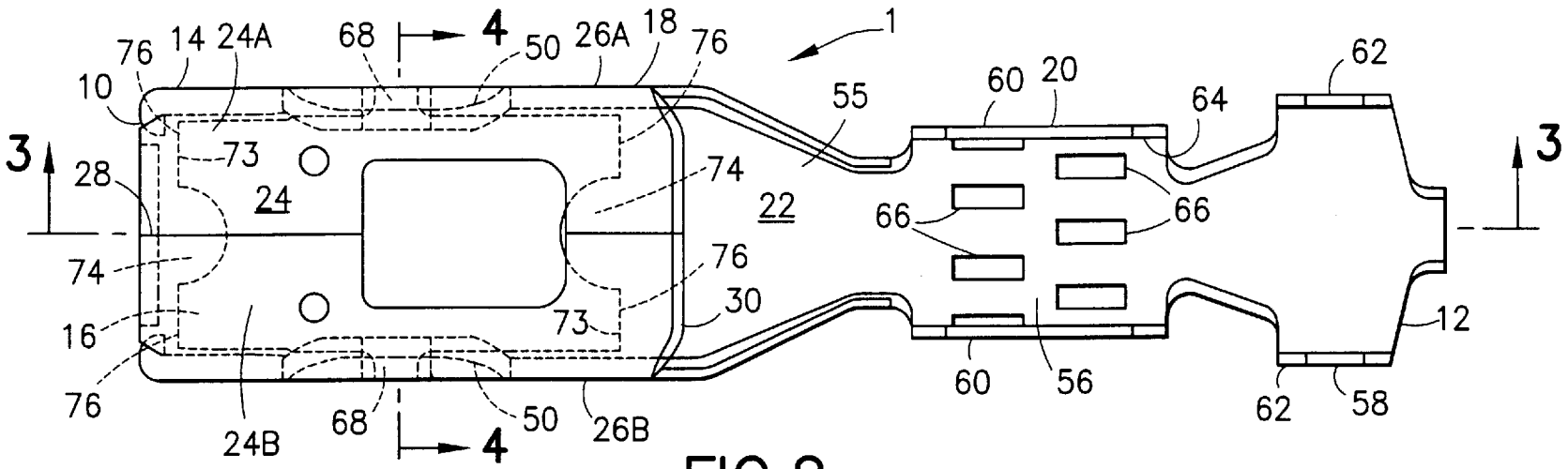
FIG. 2 is a top plan view of the electrical receptacle terminal in FIG. 1, now with the receptacle section being fully formed.

Referring now to FIGS. 1 and 2, the terminal body 14 is a one piece member made from sheet metal or other conductive material. The terminal body 14 has a front receptacle section 18 and a rear conductor connection section 20. As seen best in FIG. 4, the front receptacle section 18 is an open shell adapted to admit a male contact 200 therein. In the preferred embodiment, the shell of the receptacle section 18 has a generally rectangular cross-section. In alternate embodiments, the shell may have any other suitable cross-section to admit a male contact therein. The receptacle section 18 has a bottom 22, a top 24 and two side walls 26A, 26B connecting the top 24 to the bottom 22. The top 24 of the receptacle section has a open seam 28 extending from the front end 10 of the electrical receptacle terminal 1 to the rear end 30 of the receptacle section 18. In the preferred embodiment, the seam 28 is located to generally bisect the top 24 of the receptacle section 18 (see FIG. 2). In an alternate embodiment, the open seam may be located offset to one side or another to form two unequal portions in the top of the receptacle section. In another alternate embodiment, the open seam may located at the juncture or corner between the top and one of the side walls of the receptacle section. Each half section 24A, 24B of the top 24 of the receptacle section is cantilevered from a corresponding side wall 26A, 26B.

Figure 3:
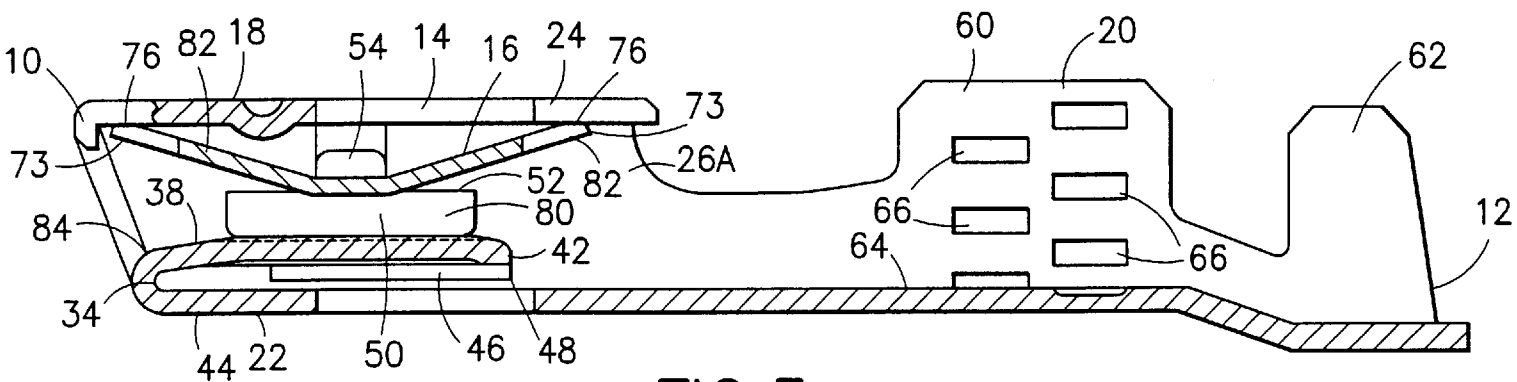
FIG. 3 is a cross-sectional elevation view of the electrical receptacle terminal shown in FIG. 2 taken along lines 3—3.
Figure 4:
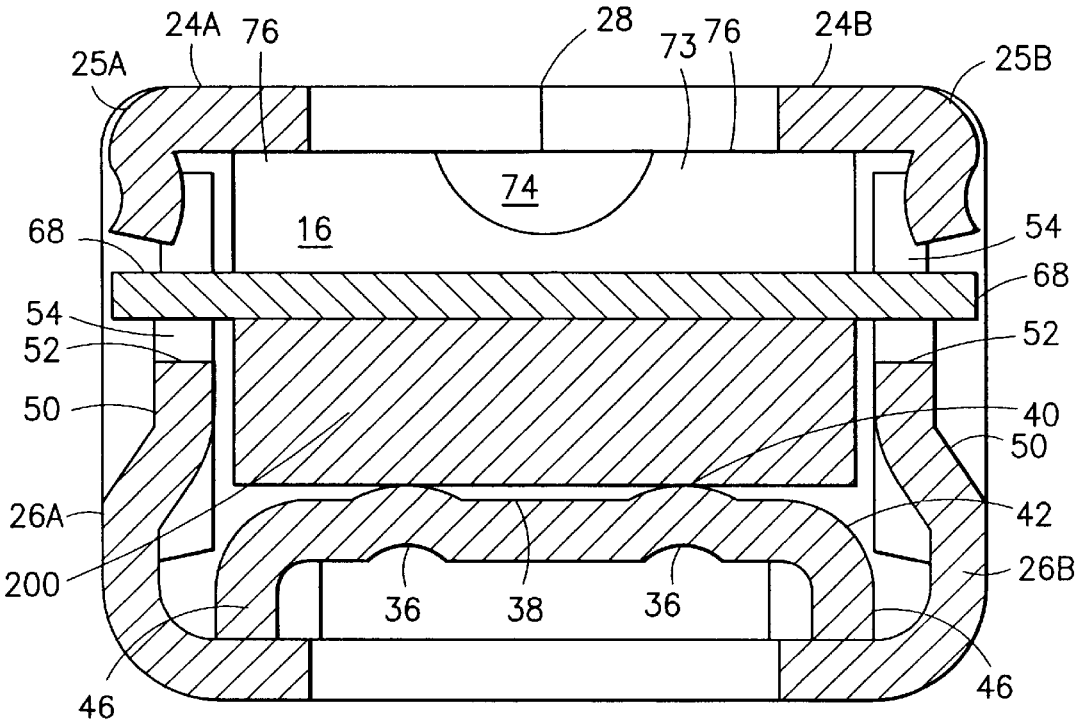
FIG. 4 is a cross-sectional elevation view of the electrical receptacle terminal shown in FIG. 2 taken along lines 4—4, with a male contact inserted in the receptacle section.

Referring now to FIGS. 1 and 3, the bottom 22 of the receptacle section 18 is substantially flat and has a tab 32 extending therefrom at the front end 10 of the electrical receptacle terminal 1. The tab 32 is bent over itself at the front end 10 of the electrical receptacle terminal 1 so that the tab 32 extends within the receptacle section 18 (see FIG. 3). The bent over tab 32 and the bottom 22 of the receptacle section 18 form a resiliently flexible general clip configuration which acts as a lower spring 34 within the receptacle section 18. The tab 32 forms the spring arm 42 of the lower spring 34 and the bottom 22 of the receptacle section forms the base 44 of the spring 34. The tab 32 has two longitudinal indentations 36. As shown in FIG. 4, the indentations 36 distort the upper surface 38 of the lower spring 34 to form rounded contact areas 40 on the upper surface of the lower spring. Still referring to FIG. 4, the spring arm 42 of the spring 34 has two down-turned flanges 46 adjacent the side walls 26A, 26B of the receptacle section 18. A gap 48 is formed between the flanges 46 and the bottom 22 of the receptacle section 18 (see FIG. 3). The gap 48 allows the spring arm 42 of the spring 34 to be resiliently deflected down from its home position. The flanges 46 snub against the bottom 22 of the receptacle section 18 to limit the downward deflection of the spring arm 42 (see FIG. 4).

Referring now to FIGS. 2 and 4, each side wall 26A, 26B of the receptacle section 18 has an inward shoulder section 50. Each inward shoulder section 50 has a free upper edge 52 offset inwards relative to the corresponding side wall 26A, 26B. In addition, each side wall 26A, 26B has a vertical slot 54 formed therein (see also FIG. 3). The slots 54 are bounded at the bottom by the upper edges 52 of the shoulder sections 50.

Referring now to FIGS. 1, 2 and 3, the rear conductor connection section 20 includes a transition section 55, an intermediate section 56 and a distal section 58. The transition section 55 connects the rear conductor connection section 20 to the receptacle section 18 of the electrical receptacle terminal 1. The intermediate section 56 and distal section 58 have a general channel configuration. The intermediate section 56 is adapted to receive a conducting core of a conductor (not shown). The distal section 58 is somewhat wider than the intermediate section 56 in order to admit a portion of the conductor having insulation thereon. Both the intermediate section 56 and the distal section 58 have side compression tabs 60, 62. The electrical receptacle terminal 1 is connected to the conductor by placing the conductor in the conductor connection section 20 and compressing the tabs 60, 62 onto the conductor. The side compression tabs 60 of the intermediate section 56 are compressed downward around the conducting core of the conductor to crimp the conducting core to the intermediate section 56. The inner surface 64 of the intermediate section 56 has a series of grooves 66 formed therein which engagingly contact the conducting core crimped in the intermediate section 56. The grooves 66 improve the electrical contact between the terminal 1 and the conductor as well as provide increased resistance to pullout forces tending to separate the conductor from the terminal. The side tabs 62 on the distal section 58 of the conductor connection section 20 are pressed downward around the insulated portion of the conductor to crimp the insulated portion in the distal section 58 of the terminal 1.

Referring now to FIGS. 1 and 2, the spring 16 is stamped from sheet metal or other conductive material. The spring 16 has a general leaf spring configuration. When viewed from a top plan view, the spring 16 has a substantially rectangular form (see FIG. 2). Two side tabs 68 project laterally from the longitudinal or sloped edges 70 of the spring 16. The side tabs 68 are located generally at the middle or base 78 of the spring 16. The side tabs 68 have an appropriate length and width to be admitted into the vertical slots 54 in the side walls 26A, 26B of the receptacle section 18 when the spring 16 is mounted to the terminal body 14. The edges 72 at the ends 73 of the leaf spring 16 each have a scalloped cutout 74 formed therein. The scalloped cutout 74 is located substantially at the center of each edge 72 forming two support surfaces 76 at each edge 72.

Referring now to FIGS. 2 and 3, the spring 16 is mounted to the body 14 of the electrical receptacle terminal 1 within the receptacle section 18. The spring 16 is positioned and orientated within the receptacle section 18 to form an upper spring opposite the lower spring 34. The spring 16 is installed in the receptacle section 18 with the base 78 down and the leaf ends 73 up. The side tabs 68 of the spring 16 extend into the vertical slots 54 in the side walls 26A, 26B of the receptacle section 18 (see FIG. 2). The spring 16 is captured vertically between the upper edges 52 of the shoulder sections 50 on the side walls 26A, 26B and the top 24 of the receptacle section 18. The side tabs 68 in the vertical slots 54 are seated on the upper edges 52 of the shouldered sections 50. The supports surfaces 76 at the ends 73 of the spring 16 rest against the top 24 of the receptacle section 18. One support surface 76 at each end 73 rests against each top half section 24A, 24B. The support surfaces 76 of the spring 16 contact the top half sections 24A, 24B adjacent the corners 25A, 25B of the top half sections 24A, 24B and side walls 26A, 26B (see FIGS. 2 and 4). The scalloped cutouts 74 in the ends 73 of the spring 16 are located under the open seam 28 in the top 24 of the receptacle section 18. The support surfaces 76 at each end 73 which are separated by the cutouts 74, thus do not contact the respective top half sections 24A, 24B adjacent the seam 28 between the top half sections (see FIGS. 2 and 4). Horizontally, the spring 16 is held in the receptacle section 18 by the side tabs 68 located in the vertical slots 54. The vertical slots 54 provide little horizontal or side play for tabs 68. However, the tabs 68 are free to move upward within the vertical slots 54 when the base 78 of the spring 16 is resiliently deflected upwards. Thus, the spring 16 is movably captured within the receptacle section 18 of the terminal body 14. The tabs 68 support the spring 16 from the upper edges 52 of the shouldered sections 50 so that a gap 80 is formed between the base 78 of the spring 16 and the spring arm 42 of the lower spring 34.

The electrical receptacle terminal 1 is fabricated generally as follows. The description of the fabrication of the electrical receptacle terminal 1 is made with reference to FIG. 1 which shows the receptacle terminal 1 in a partially fabricated state. The terminal body 14 and spring 16 of the electrical receptacle terminal 1 are initially stamped or cut from sheet metal. The stamped work piece for the terminal body (not shown) has a central spar supporting a number of side tabs with the appropriate shape to form the receptacle section 18 and rear conductor connection section 20 of the terminal body 14. The center spar of the stamped work piece forms the bottom 23 of the terminal body 14 (see FIG. 1). The tab 32 for the lower spring 34 of the receptacle section 18 projects from the front of the center spar. To form the terminal body 14 from the stamped work piece, first the tab 32 is bent over itself to form the lower spring 34 of the receptacle section 18 (see FIG. 3). Then, the side tabs on the center spar are folded to form the side walls 26A, 26B and top half sections 24A, 24B of the receptacle section 18. The tabs which form the rear conductor connection section 20 are also bent at this time. Simultaneous with the formation of the side walls 26A, 26B and top half sections 24A, 24B of the receptacle section 18, and in any event before bending the side walls 26A, 26B into their final position to form the shell of the receptacle section 18, the stamped work piece for the spring 16 is also formed into the leaf spring shape. The spring 16 is then positioned in the still open receptacle section and the side walls 26A, 26B are bent to their upright position to form the seamed shell of the receptacle section 18. As the side walls 26A, 26B are bent upright, the side tabs 68 of the leaf spring 16 enter the corresponding vertical slots 54 in the walls 26A, 26B to capture the spring 16 within the receptacle section 18.

The electrical receptacle terminal 1 is mated to a male contact by inserting the male contact into the front end 10 of the receptacle section 18. Within the receptacle section, the male contact is inserted into the gap 80 between the spring 16 and the lower spring 34 of the receptacle section. As the male contact is inserted into the gap 80, the contact acts against the sloped arms 82 of the spring 16 and the cammed surface 84 of the spring arm 42 on the lower spring 34 resiliently deflecting the springs 16, 34 away from each other. Thus, as seen in FIG. 4, the spring arm 42 of the lower spring 34 is deflected downward and the spring 16 is biased upward against the top 24 of the receptacle section 18 by the male contact 200 located in gap 80. Conversely, the compressed upper and lower springs 16, 34 cooperate to clamp the male contact 200 therebetween. The upward bias of the spring 16 presses the support surfaces 76 at the ends 73 against the top half sections 24A, 24B. The scalloped cutouts 74 in the ends 73 of the spring 16 prevent the ends 73 of the spring 16 from thrusting against the top 24 of the receptacle section under and adjacent the seam 28 in the top 24. Thus, the spring compression loads are imparted by the support surfaces 76 against the top half sections 24A, 24B adjacent the corners 25A, 25B between the respective top sections 24A, 24B and the corresponding side walls 26A, 26B of the receptacle section 18.

Electrical receptacle terminals having a seamed receptacle section are known in the art and are highly desirable because they are inexpensive to manufacture. However, the seam in the receptacle section renders the receptacle section flexible which prevents the receptacle section from generating high clamping loads on the contacts therein. High clamping loads reacted by the spring inside the receptacle section against the structure of the receptacle section, tend to spread open the seam in the receptacle section which reduces the clamping loads exerted against the contact. Low clamping forces between the contact and the receptacle section result in poor electrical contact between contact and receptacle.

The present invention resolves the problem arising from the undesirable flexibility inherent in receptacle sections having a seam therein. The scalloped cutouts 74 in the ends 73 of the leaf spring 16 provide support surfaces for the spring which direct the compression force in the spring away from the most flexible areas of the receptacle section 18 (i.e. the areas adjacent the open seam 28) and towards the more rigid sections of the shell (i.e. the corners 25A, 25B). By reacting the spring compression loads against the corners 25A, 25B of the receptacle section 14, the spring 16 can generate higher clamping forces on the contact without substantially spreading open the seam 28 in the receptacle section 18. Furthermore, the addition of a lower spring 34 within the receptacle section 18 to clamp the contact in cooperation with the upper spring 16 also lessens the tendency of the seam 28 to spread open from clamping forces reacted against the top 24 of the receptacle section 18. In effect, the lower spring 34 reduces the compression force reacted by the upper spring 16 against the top 24 of the receptacle section 18 without reducing the overall clamping force applied on the contact in the receptacle section 18.

It should be understood that the above description is merely illustrative of the invention. Various alternatives and modifications can be devised by those skilled in the art without departing from this invention. Accordingly, the present invention is intended to embrace all such alternatives, modifications and variances which fall within the appended claims.

What is claimed is:

1. An electrical receptacle terminal comprising:

a frame with a receptacle section for a male terminal, the receptacle section having a general shell configuration with one side of the shell having a seam therein, the seam being located to section the side of the receptacle section into two cantilevered side sections with each side section being cantilevered from an opposite wall of the receptacle section parallel to the seam; and a leaf spring movably captured within the receptacle, the leaf spring being biased against the shell of the receptacle section with opposite ends of the leaf spring contacting the side of the shell;

wherein the leaf spring has two pairs of support surfaces, one pair of the support surfaces being located at each of the opposite ends of the leaf spring, one support surface of each pair of support surfaces contacting a corresponding one of the cantilevered side sections adjacent the wall of the receptacle section from which the side section cantilevers so that when the male terminal is inserted into the receptacle section the leaf spring is urged against the shell without substantially spreading the seam.

2. An electrical receptacle terminal as in claim 1, wherein the leaf spring has two cutouts formed therein, one of the cutouts being formed in each of the opposite ends of the leaf spring, the cutouts being located so that the seam in the shell of the receptacle extends over both cutouts in the spring.

3. An electrical receptacle terminal comprising:

a frame with a receptacle section for a male terminal, the receptacle section having a general shell configuration with a substantially rectangular cross-section, and having an open seam in a side of the shell;

a first spring movably captured within the receptacle section, the spring being biased against the shell of the receptacle; and a second spring within the receptacle section to press the male terminal against the first spring when the male terminal is located within the receptacle section, wherein the second spring is formed by a tab member extending from the frame into the receptacle section;

wherein the first spring contacts the shell of the receptacle section proximate a corner of the rectangular cross-section so that when the male terminal is located in the receptacle section the first spring is thrust against the shell without substantially deflecting the side of the shell having the seam therein.

4. An electrical receptacle terminal as in claim 3, wherein the tab member is connected to a front end of the frame.

5. An electrical receptacle terminal as in claim 3, wherein the tab member is bent upon itself, the free edge of the tab facing a rear connector end of the frame.

6. An electrical receptacle terminal as in claim 3, wherein the first spring is supported from the receptacle section to form a gap between the first spring and the second spring.

7. An electrical receptacle terminal as in claim 3, wherein the first spring has a general leaf spring configuration with a substantially rectangular top.

8. An electrical receptacle terminal as in claim 7, wherein the first spring contacts the shell of the receptacle section at opposite ends of the leaf, and wherein at least one of the opposite ends of the leaf has a generally centered cutout therein located to form a pair of contact areas with one contact area of the pair of contact areas contacting the shell of the receptacle on each side of the open seam in the receptacle.

9. An electrical receptacle terminal as in claim 3, wherein the tab member has at least one folded flap which snubs deflection of the tab member against the receptacle section.

10. In an electrical receptacle terminal comprising a frame with a receptacle section for a male terminal and a first spring movably captured within the receptacle section, the receptacle section having a general shell configuration with an open seam therein and the spring being biased against the shell of the receptacle, wherein the improvement comprises:

the frame having a member cantilevered from a side of the receptacle section to form a second spring within the receptacle section, the second spring being located in the receptacle section so that when the male terminal is located within the receptacle section the second spring and first spring cooperate to sandwich the male terminal therebetween; and the first spring member having an edge biased against the shell, the edge having a cutout formed therein and located so that the open seam is located over the cutout.

11. An electrical receptacle terminal comprising:

a frame with a receptacle section for a male terminal, the receptacle section having a general shell configuration with one side of the shell having a seam therein and at least one edge parallel to the seam, the edge of the side being anchored to a remaining portion of the shell; and a leaf spring movably captured within the receptacle, the spring being biased against the shell of the receptacle section with opposite ends of the leaf spring contacting the side of the shell having the seam;

wherein the leaf spring has at least one support surface at each of the opposite ends, the support surface at each opposite end of the spring contacting the side adjacent the anchored edge of the side without resting on the seam so that when the male terminal is inserted into the receptacle section the leaf spring is urged against the shell without substantially spreading the seam.

12. An electrical receptacle terminal as in claim 11, wherein at least one of the opposite ends of the leaf spring has a cutout formed therein, the cutout being disposed substantially symmetrically about a center axis of the leaf spring so that the end of the leaf spring having the cutout defines a generally forked configuration.

* * * * *